US005330281A

United States Patent [19]

Kalan

[11] Patent Number: 5,330,281

[45] Date of Patent: Jul. 19, 1994

[54] DEVICE FOR MOUNTING PHOTOGRAPHS AND THE LIKE

[76] Inventor: Robert Kalan, 1040 148th Dr. SE., Bellevue, Wash. 98007

[21] Appl. No.: 93,064

[22] Filed: Jul. 16, 1993

[51] Int. Cl.[5] ..... B42F 13/00

[52] U.S. Cl. ..... 40/73

[58] Field of Search ..... 281/15.1, 17, 21.1, 281/22, 29, 31, 37, 38; 402/70, 73, 78, 80 R; 40/124.1, 539

[56] References Cited

U.S. PATENT DOCUMENTS

| | | | |
|---|---|---|---|
| 944,385 | 12/1909 | Spiegel | 40/124.1 |
| 2,801,115 | 7/1957 | Federbush et al. . | |
| 3,078,107 | 2/1963 | Loderhose | 281/29 |
| 3,797,152 | 3/1974 | Brandt . | |
| 3,875,693 | 4/1975 | Pelkey . | |
| 4,001,960 | 1/1977 | Holson . | |
| 4,301,962 | 11/1981 | Monckton et al. . | |
| 4,470,620 | 9/1984 | Gerch . | |
| 4,629,349 | 12/1986 | Pitts | 402/74 |
| 4,636,179 | 1/1987 | Gentile et al. . | |
| 4,819,962 | 4/1989 | Takai . | |
| 4,934,584 | 6/1990 | Wyant . | |
| 4,965,948 | 10/1990 | Ruebens . | |
| 4,991,767 | 2/1991 | Wyant . | |
| 5,100,181 | 3/1992 | Nathans et al. . | |

*Primary Examiner*—Mark Rosenbaum
*Assistant Examiner*—Willmon Fridie, Jr.
*Attorney, Agent, or Firm*—Blakely, Sokoloff, Taylor & Zafman

[57] ABSTRACT

A preprinted foldable sheet for displaying a photograph contains an aperture, behind which the photograph may be mounted, and a folding flap that overlies the aperture. Indicia are imprinted on the face of the sheet and corresponding indicia are imprinted on the flap in such a manner as to be in registration with the indicia on the face of the sheet when the flap is folded behind the aperture. In this manner, there is continuity of the indicia across the aperture so that a pleasing appearance is maintained even when a photograph is not placed behind the aperture.

11 Claims, 2 Drawing Sheets

DEVICE FOR MOUNTING PHOTOGRAPHS AND THE LIKE

BACKGROUND OF THE INVENTION

1. Field of the Invention

This invention relates generally to the field of devices for displaying photographs and other memorabilia, and specifically to a preprinted folder having a photograph receiving aperture for use as a binder insert, portfolio cover or the like.

2. Prior Art

Albums for displaying photographs are available in a wide variety of styles. Almost without exception, the individual pages of photo albums are devoid of printed matter so as not to detract from the subject matter of the photographs displayed therein. Some photo album pages, such as that shown in U.S. Pat. No. 3,797,152, have cutouts for framing the individual photographs.

Notebook covers and portfolios adapted for displaying photographs are also known. For example, U.S. Pat. No. 4,991,767 discloses a portfolio with a photograph displaying cover in which a number of pockets are provided for the insertion of photographs. U.S. Pat. No. 4,819,962 discloses a notebook in which the pages have a window-like aperture so that a photograph inserted in a pocket of the notebook cover may be viewed even as the pages of the notebook are turned.

SUMMARY OF THE INVENTION

An object of the present invention is to provide a preprinted foldable sheet for displaying a photograph or other item of memorabilia. The sheet is intended, however, to have intrinsic value apart from its use for displaying a photograph. For example, the sheet may be imprinted with photography, artwork or other indicia that have value to a purchaser as a memento, collectable item or the like.

The sheet contains an aperture, behind which the photograph may be mounted and a folding flap that overlies the aperture. The desired indicia are imprinted on the face of the sheet and corresponding indicia are imprinted on the flap in such a manner as to be in registration with the indicia on the face of the sheet when the flap is folded behind the aperture. In this manner, there is continuity of the indicia across the aperture so that a pleasing appearance is maintained even when a photograph is not placed behind the aperture.

When a photograph is mounted to the sheet, the flap covers the back side thereof, and thus both sides of the sheet have a pleasing appearance whether a photograph is inserted or not. Instructions for use of the sheet may be imprinted on the reverse side thereof adjacent the aperture or on a portion of the flap that is not visible through the aperture when the flap is closed. In either case, the instructions will be covered by the flap whether or not the photograph is inserted.

DETAILED DESCRIPTION OF THE INVENTION

In the following description, for purposes of explanation and not limitation, specific details are set forth in order to provide a thorough understanding of the present invention. However, it will be apparent to one skilled in the art that the present invention may be practiced in other embodiments that depart from these specific details. In other instances, detailed descriptions of well-known methods and devices are omitted so as to not obscure the description of the present invention with unnecessary detail.

Figure 1:
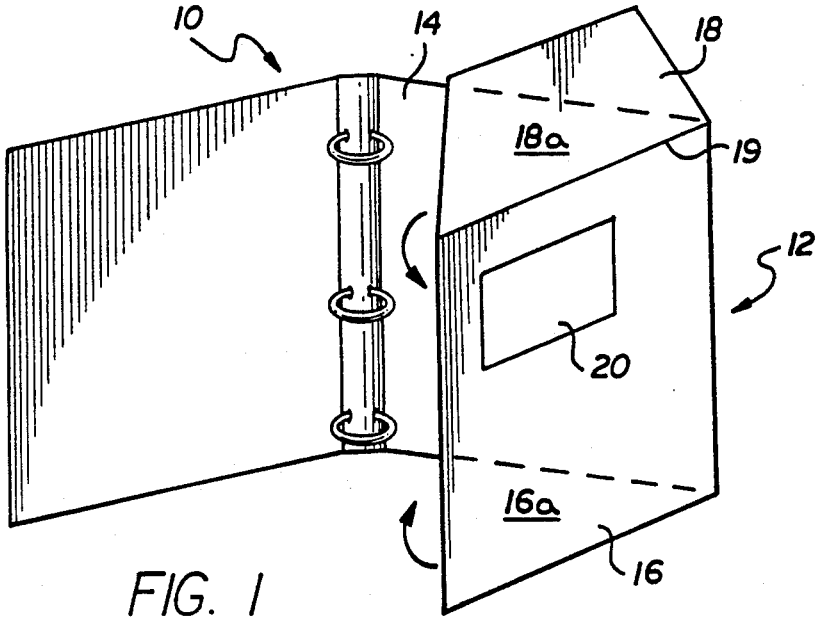
FIG. 1 is a perspective view of a folder constructed in accordance with the present invention.

FIG. 1 illustrates a notebook 10 having a cover 12 that is constructed in accordance with the present invention. Although a loose-leaf notebook is illustrated, any other type of binding method may be employed. In fact, cover 12 may be used with a permanently bound book or booklet such as a sporting event program, a children's storybook, a guidebook to a tourist attraction, etc.

Cover 12 comprises a panel 14 that forms one of the outside covers of the notebook, a main panel 16 and a flap panel 18. Panels 16 and 18 are preferably formed from a single sheet of cardboard or heavy paper material that is scored along line 19 so that flap panel 18 can be folded down against main panel 16. Panels 16 and 18 may be made together with panel 14 from a single piece of material or, alternatively, panel 14 may be made from a heavier stock of material and panel 16 may be secured thereto with a suitable adhesive. In either case, panels 14 and 16 are foldably connected at edge 15 so that panel 16 may be folded back to lie on panel 14. In alternative embodiments, the flap panel may fold upward from the bottom of the main panel or inward from either the left or right edge of the main panel.

Main panel 16 has a "front" surface **16*a* and a "rear" surface 16*b* (obscured in FIG. 1). Flap panel 18 has a first surface 18*a* that is contiguous with surface 16*a* and a second surface 18*b* that is contiguous with surface 16*b*. In normal use of binder 10, flap panel 18 is folded downwardly against main panel 16 with surface 18*b* in contact with surface 16*b***.

Main panel 16 has at least one aperture 20 therein. A rectangular aperture is illustrated; however, aperture 20 may be of any size or shape. Furthermore, a plurality of apertures 20 may be provided if desired. Aperture 20 is preferably formed by a die-cutting process. The dimensions of flap panel 18 are such that it will overlie the entirety of aperture 20 when folded against main panel 16. In an alternative arrangement, the aperture or apertures may be cut in the flap panel instead of the main panel.

Figure 2:
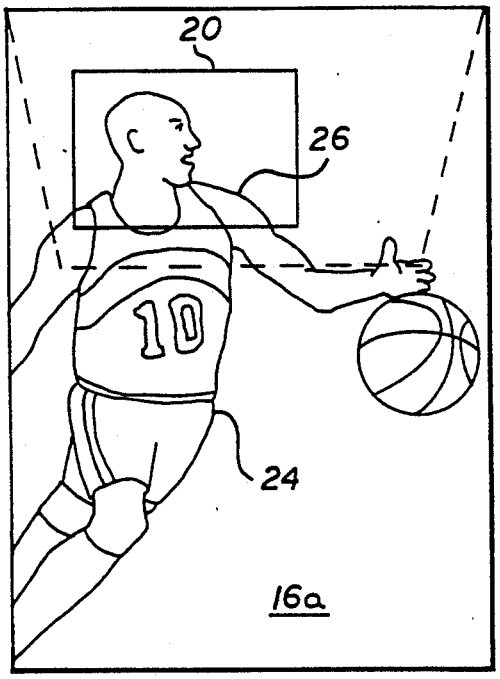
FIG. 2 illustrates the appearance of the folder of FIG. 1 without insertion of a photograph.

Referring now to FIG. 2, surface **16*a* of main panel 16 is illustrated with flap panel 18 therebehind. Surface 16*a* is preferably imprinted with indicia 24 which adds intrinsic value to notebook 10. For example, notebook 10 may be intended as a keepsake memento or a collectable item in its own right, apart from any other utilitarian purpose. Corresponding indicia 26 are imprinted on surface 18*b* of flap panel 18. Indicia 26 are therefore visible through aperture 20 when flap panel 18 is folded downwardly behind main panel 16. Indicia 24 and 26 correspond such that they are in registration along the edges of aperture 20. Accordingly, the presence of aperture 20 is not obvious due to the continuity of indicia 24 and 26. Cover 12 therefore has a pleasing appearance even though nothing has been inserted behind aperture 20**.

Figure 3:
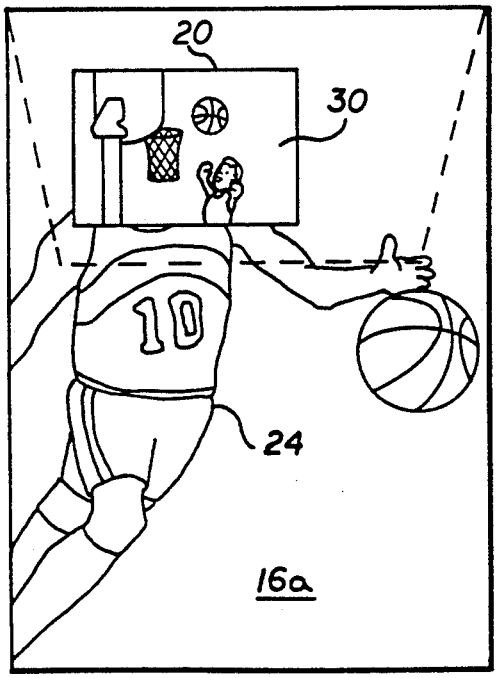
FIG. 3 illustrates the same folder shown in FIG. 2, but with a photograph inserted.

However, aperture 20 is intended for the display of a photograph or other item of memorabilia. Naturally, if a plurality of apertures are provided, a similar plurality of photographs or other items may be displayed. Referring now to FIG. 3, surface 16*a* of main panel 16 is shown with a photograph 30 inserted behind aperture 20. Indicia 24 are, of course, still visible on surface 16*a*; however, indicia 26 imprinted on flap panel 18 are now obscured by photograph 30.

Figure 4:
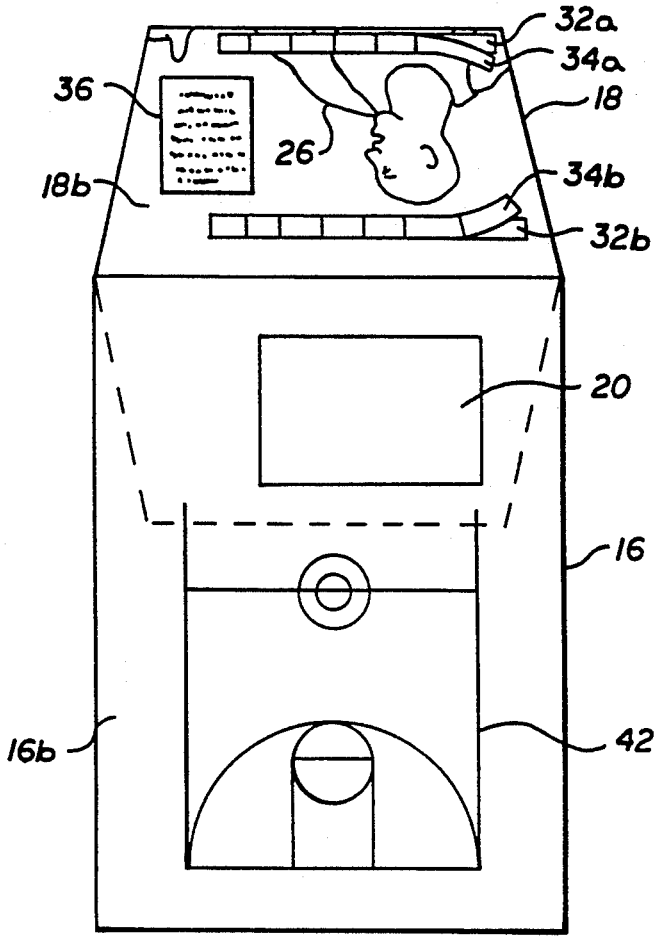
FIG. 4 illustrates the reverse side of the folder shown in FIGS. 1–3 with the covering flap extended.

FIG. 4 illustrates the rear of panels 16 and 18 with surfaces 16*b* and 18*b* exposed to view. A pair of adhesive strips 32*a*, 32*b* are provided for the purpose of securing photograph 30. The adhesive strips may be mounted on surface 16*b* of the main panel adjacent to aperture 20 or, as shown in FIG. 4, on surface 18*b* of the flap panel in positions that will straddle aperture 20 when the flap panel is closed. Adhesive strips 32*a*, 32*b* preferably comprise a relatively low tack adhesive sufficient for securing photograph 30, but allowing it to be removed without damage if desired.

Adhesive strips 32*a*, 32*b* preferably extend somewhat beyond the edges of photograph 30 so that they will also secure flap panel 18 in a closed position against main panel 16. Protective strips 34*a*, 34*b* are provided to cover adhesive strips 32*a*, 32*b*, respectively, prior to use. Protective strips 34*a*, 34*b* preferably comprise a plurality of short segments so that items may be loosely secured with only one or two adhesive segments exposed. This allows for the temporary mounting of items and also facilitates positioning of an item to be viewed through aperture 20. Proper positioning is further facilitated by the repetition of a portion of indicia 24 in the form of indicia 26 on surface 18*b* of the flap panel. This allows the photograph or other item to be laid upon the flap panel and previewed as it will appear through the aperture. This obviates the need for such traditional positioning aids as corner markers and positioning grids. Further, the registration of indicia 26 with indicia 24 allows photographs and other items that are smaller than aperture 20 or that may be positioned so as to not completely fill the aperture to be mounted without detracting from the visual appearance of the completed panel.

Figure 5:
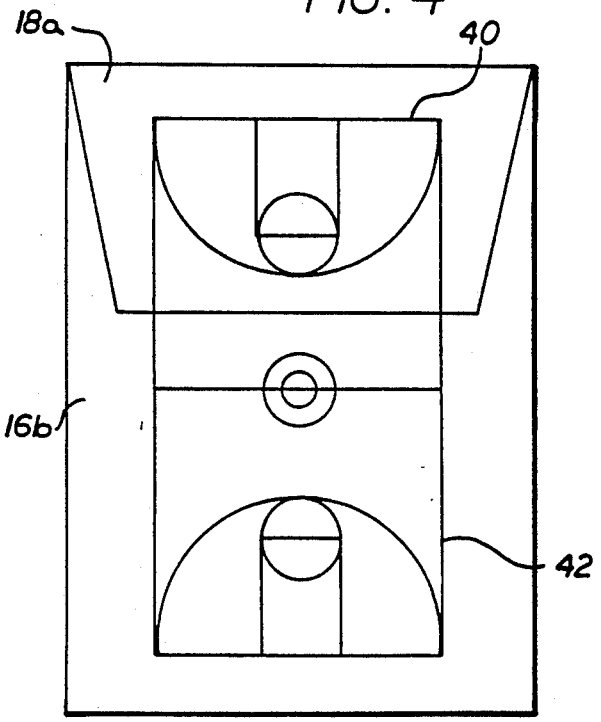
FIG. 5 illustrates the reverse side of the folder as in FIG. 4, but with the covering flap closed.

Instructions for use and other informative text may be imprinted on surface 18*b* of flap panel 18 in area 36. Alternatively, or in addition, text may also be imprinted on surface 16*b* within the area enclosed by the dotted line. Such text, together with aperture 20 (or the rear of photograph 30), will be concealed from view by flap panel 18 when it is folded down. Surface 18*a* of flap panel 18, which overlies surface 16*b* of main panel 16 when flap panel 18 is folded down, may be imprinted with additional indicia 40 which, if desired, may be in registration with corresponding indicia 42 imprinted on the lower portion of surface 16*b* as illustrated in FIG. 5.

Figure 6:
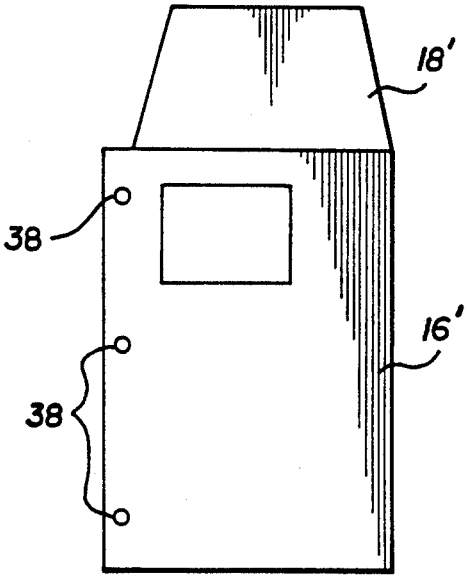
FIG. 6 illustrates an alternative embodiment of the present invention in the form of a binder insert.

Referring again to FIG. 1, it will be recognized that the present invention may be embodied in a portfolio which would simply comprise panels 14, 16 and 18 without the remainder of the notebook. Furthermore, the present invention may be embodied as a loose-leaf insert comprising only main panel 16' and flap panel 18' as illustrated in FIG. 6. In this embodiment, main panel 16' is provided with a plurality of holes 38 for insertion in a standard snap ring binder. Numerous other embodiments of the present invention will be apparent from the foregoing disclosure. Thus, it is understood that the invention is not to be limited by the foregoing illustrative details, but rather is to be defined by the appended claims.

I claim:

1. A device for framing a item of memorabilia comprising:

a first panel having a front surface, a rear surface and an aperture therein;

a second panel foldably connected to the first panel along an edge thereof and foldable against the rear surface of the first panel so as to overlie the aperture, said second panel having a first surface and a second surface, said second surface being partially exposed through said aperture when the second panel is folded against the rear surface of the first panel;

said front surface of the first panel having first indicia printed thereon and said second surface of the second panel having corresponding second indicia printed thereon so as to be visible through the aperture when the second panel is folded against the rear surface of the first panel, said first and second indicia being substantially in registration along the edges of the aperture when the second panel is folded against the rear surface of the first panel; and means for securing the item of memorabilia to be viewed through the aperture.

2. The device of claim 1 wherein the securing means comprises at least one adhesive strip.

3. The device of claim 1 wherein the second panel comprises a flap panel that is substantially smaller than the first panel.

4. The device of claim 1 wherein the first panel is foldably connected to a notebook cover.

5. The device of claim 1 wherein the first panel is foldably connected to a portfolio cover.

6. The device of claim 1 wherein the first panel comprises a notebook insert.

7. The device of claim 2 wherein the adhesive strip extends beyond the item of memorabilia so as to adhesively secure the second panel against the rear surface of the first panel.

8. A notebook comprising:

first and second cover portions;

a main panel foldably connected to one of the first and second cover portions, said main panel having a front surface, a rear surface and an aperture therein;

a flap panel foldably connected to the main panel along an edge thereof and foldable against the rear surface of the main panel so as to overlie the aperture, said flap panel having a first surface and a second surface, said second surface being partially exposed through said aperture when the flap panel is folded against the rear surface of the main panel;

said front surface of the main panel having first indicia printed thereon and said second surface of the flap panel having corresponding second indicia printed thereon such that said first and second indicia are substantially in registration when the flap panel is folded against the rear surface of the main panel; and means disposed on the second surface of the flap panel for securing an item of memorabilia to be viewed through the aperture.

9. The device of claim 8 wherein the securing means comprises at least one adhesive strip.

10. The device of claim 8 wherein the flap panel is substantially smaller than the main panel.

11. The device of claim 9 wherein the adhesive strip extends beyond the item of memorabilia as to adhesively secure the flap panel against the rear surface of the main panel.

* * * * *